United States Patent [19]

Lafreniere et al.

[11] Patent Number: 4,874,348

[45] Date of Patent: Oct. 17, 1989

[54] HANDLING DEVICE FOR COINS, TOKENS AND THE LIKE

[75] Inventors: Dennis R. Lafreniere; Ronald E. McConnell, both of Swift Current, Canada

[73] Assignee: Dennis R. LaFreniere, Swift Current, Canada

[21] Appl. No.: 191,230

[22] Filed: May 6, 1988

[51] Int. Cl.[4] ..... G07D 1/00

[52] U.S. Cl. ..... 453/50; 453/60; 221/281; 221/309

[58] Field of Search ..... 453/50, 51, 52, 58, 453/59, 60, 61, 62; 53/213, 254; 206/82; 221/309, 310, 311, 261, 267, 280, 281; 194/343

[56] References Cited

U.S. PATENT DOCUMENTS

| | | | |
|---|---|---|---|
| 583,808 | 6/1897 | Lazell . | |
| 1,011,272 | 12/1911 | Teeter et al. | 453/48 |
| 2,242,933 | 5/1941 | Wagner . | |
| 2,443,862 | 6/1948 | Justus . | |
| 2,802,325 | 8/1957 | Capodanno | 53/254 |
| 2,960,259 | 11/1960 | Aveni . | |
| 3,306,493 | 2/1967 | Szajna . | |
| 3,393,688 | 7/1968 | Saverino . | |
| 3,998,238 | 12/1976 | Nigro . | |
| 4,091,599 | 5/1978 | Lemieux . | |

FOREIGN PATENT DOCUMENTS

| | | | |
|---|---|---|---|
| 2171829 | 9/1986 | United Kingdom | 453/52 |

*Primary Examiner*—F. J. Bartuska
*Attorney, Agent, or Firm*—Irell & Manella

[57] ABSTRACT

A coin dispenser for coins, tokens and the like comprises a tube with a loading scoop at one end and a dispensing slot at the other with the floor of the tube becoming planar and inclining downwardly from adjacent the other end of the tube towards the dispensing slot. The top of the tubular portion over the planar floor is open so that individual coins on the floor can be engaged by the thumb of the user grasping the tube and urged out through the dispensing slot one at a time facilitated by the angle of inclination of the floor. These coins can be fitted directly into slot machines or any coin operated device, one at a time, with the operator ejecting the coins from the slot of the dispenser as desired.

19 Claims, 3 Drawing Sheets

FIG. 3
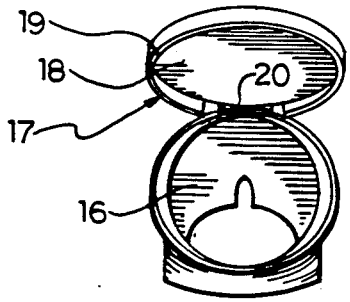
FIG. 4
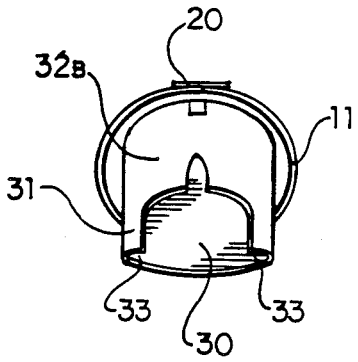
FIG. 5
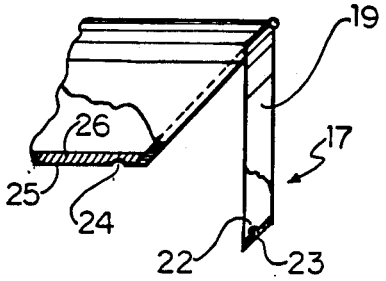
FIG. 6
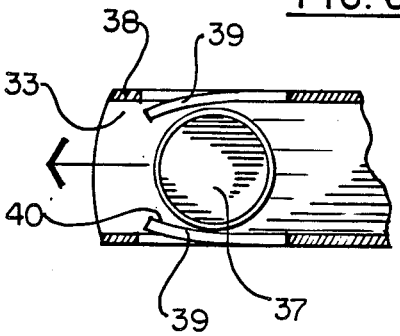
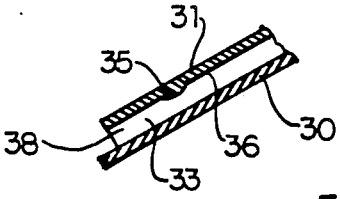
FIG. 7

HANDLING DEVICE FOR COINS, TOKENS AND THE LIKE

This invention relates to new and useful improvement in devices designed for the loading, storing, transporting, and dispensing individually any one type of coin, token or the like in an easier, cleaner and more organized manner. The invention is designed specifically for use by slot machine players in casinos, in car washes and in arcades and in any coin operated device as well as in circumstances where people utilize coins regularly or where individuals require spare change.

The device allows individuals to load and dispense a sufficient amount of similar coins quickly and directly into a coin slot of a machine without having to pick up each coin individually and insert same into the coin slot of the machine. It also allows coins to be stored conveniently and securely for a short or long period of time and then have them ready for immediate use. It enables the individual to maintain relatively clean hands and clothes inasmuch as it eliminates the individual handling of each coin. It is well known that coinage in general retains dirt and grime which is easily transferrable to the hands and/or clothing of the user and this device eliminates this fault to a great extent.

PRIOR ART

Prior art known to applicant includes the following U.S. Patents:

U.S. Pat. No. 2,242,933 A. N. Wagner issued May 20, 1941. This device shows a tube having a loading funnel at one end situated at a right angle to the tube and a dispensing slide at the other which has to be actuated each time it is desired to dispense one coin from the device.

U.S. Pat. No. 3,393,688 P. Saverino issued July 23, 1968. This shows a coin dispenser in which individual coins must be picked off one by one from the dispensing end by the thumb and forefinger. The upper side of the holder is open and a block is moved along the main body portion to maintain the coins against the dispensing end.

U.S. Pat. No. 3,998,238 George A. Nigro issued Dec. 21, 1976. This shows a tubular device which is held vertically and includes a claw type dispenser on the lower end which will permit one coin at a time to be dispensed as long as it is rested upon a planar surface.

U.S. Pat. No. 4,091,599 R. J. Lemieux issued May 30, 1978. This shows an elongated scoop in alignment with the tubular storage device and is designed primarily for counting and packaging rather than dispensing.

U.S. Pat. No. 533,808 J. D. Lazell issued June 1, 1897. This shows an oval cross sectioned tube having a slot with a tensioning spring therein which assists in moving the coins from one end of the tube to the other and a detent on the end spring which separates coins individually as they are dispensed.

U.S. Pat. No. 3,306,493 J. L. Szajna issued Feb. 28, 1967. This is a device for dispensing tablets and utilizes the flexible end moving one tablet into a dispensing portion whereupon it may be ejected therefrom by manipulating the resilient sides of the dispensing portion.

U.S. Pat. No. 2,960,259 A. Aveni issued Nov. 15, 1960. This again is a dispenser for pills pellets and the like and utilizes flexible side walls to eject same one at a time.

U.S. Pat. No. 2,443,862 W. R. Justus issued June 22, 1948. This shows a dispenser for nested articles such as fingertip shields and utilizes a construction which is not appropriate for coins, tokens or the like.

In all cases the dispensing portion is situated at one end of a tube portion and in the same plane as the tube portion making it necessary to remove a coin individually and then place it in the slot by hand.

It should be noted that the present device is for the storage and dispensing of coins, tokens, chips or any disc like object all of which are covered by the term "coins, tokens and the like" in both the specification and claims.

One of the principle advantages of the present device is that it allows an individual to load and then dispense a sufficient amount of coins quickly and directly into a coin slot without having to pick up each one and handle them individually.

The present device permits the dispenser to be held in the hand with the dispensing end adjacent a coin slot whereupon coins may be individually ejected from the dispensing end by the thumb of the operator directly into the coin slot.

In accordance with the invention there is provided a device for the loading, storing and selective dispensing of coins, tokens and the like comprising an elongated tubular holder portion, loading means at one end thereof and selective dispensing means at the other end thereof, said selective dispensing means including a transversely situated dispensing slot at the distal end of said other end and situated in a plane below the base of said tubular holder portion and having a substantially planar base portion or floor inclining upwardly towards said tubular holder portion with the cross sectional configuration of the dispensing means increasing from said slot configuration to the full diameter of said tubular holding holder portion whereby the orientation of a coin, token or the like changes from a position spanning said tubular holder portion in which the vertical plane of the coin, token or the like is at a rearwardly inclined angle to the horizontal longitudinal axis of the tubular holder portion, to a planar position upon said planar base of said dispenser means and means to detachably retain said coin, token or the like upon said planar floor until dispensed through said slot.

The device is designed to hold at least one roll of coins when loaded i.e., $10.00 worth of quarters. It is designed to be manufactured from plastic although of course metal may be used and it can be held and operated in either the right or left hand.

Charging the dispenser is made easier by a loading scoop at the other end of the storage tube which enables the operator to scoop up or load coins quickly and easily and a flip cap is attached to hold the coins securely inside at all times.

The scoop at the one end of the tube is angulated at approximately 40° from the vertical as is the dispensing nose end and this enables a quick shake of the device back and forth which will realign any coins that should get stuck or loaded at the wrong angle.

Another advantage of the device is that a narrow slot is formed in the top of the storage tube so that the user can ascertain at any time how many coins are remaining. Furthermore it should be noted that the floor of the dispensing end of the device slopes downwardly and forwardly towards a dispensing slot which is situated in a plane below the plane of the floor of the storage tube which in conjunction with flanged sides, forms a coin chute. This means that when the device is positioned with the dispensing end inclined downwardly, coins stacked in the main body slide forward and come in contact with the dispensing chute and slide forwardly, one at a time, into the chute ready for dispensing by the operator. Means are provided within the chute to detachably retain the coin until ejected manually and this one coin, at the same time holds back the next coin from entering the chute. Once the coin has been ejected by the thumb of the operator, the next coin then falls downwardly into the chute ready for ejection and the process is repeated.

Another advantage of the invention is to provide a device of the character herewithin described which is simple in construction, economical to manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 3 is a rear view of FIG. 2.

FIG. 4 is a front view of FIG. 1.

FIG. 4 is an enlarged fragmentary partially sectioned view of the loading end of the device with the cap in the partially opened position.

FIG. 6 is an enlarged view of the dispensing end of FIG. 2 but with the outsides of the flanges removed for clarity.

FIG. 7 is a fragmentary cross sectional view of one of the side flanges showing an alternative detent means to that shown in FIG. 6.

In the drawings like characters of reference indicate corresponding parts in the different figures.

DETAILED DESCRIPTION

Figure 1:
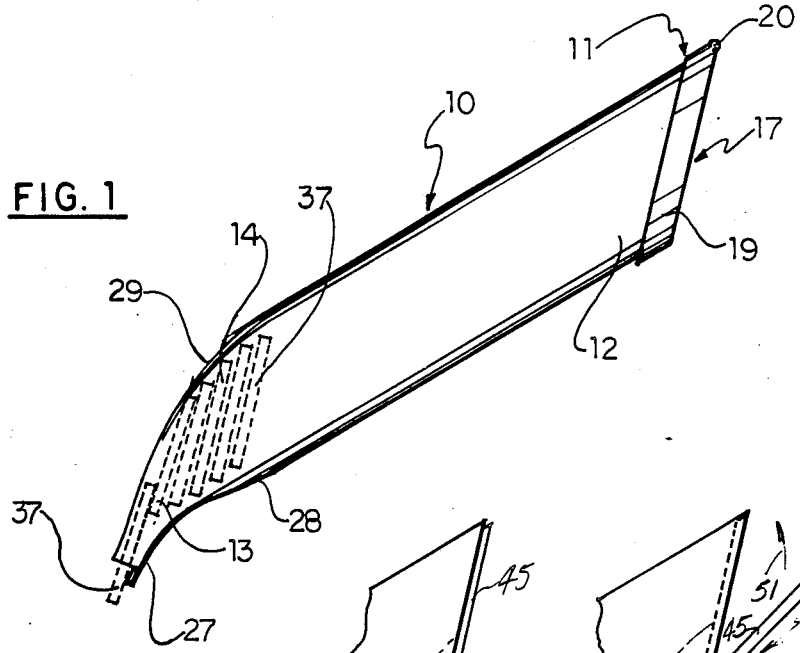
FIG. 1 is a side elevation of the device with the cap in the closed position.

Proceeding therefore to describe the invention in detail, reference character 10 illustrates a tubular holder portion preferably having a circular cross section and being formed from synthetic plastic material.

A loading means collectively designated 11 is formed on one end 12 of the holder portion 10 and a dispensing assembly 13 is formed on the other end 14 of the holder portion.

In detail, the loading portion 11 is in the form of a scoop 15 caused by expanding the end 12, said scoop having an open rear end 16 for loading purposes, it being understood that coins, tokens or the like may be poured in by hand, or alternatively, the device may be used as a scoop into a plurality of coins in order to scoop same into the open end 16 from whence they pass to the tubular holder portion when the device is tipped upwardly.

In the embodiment shown in FIGS. 1 to 5, a cap collectively designated 17 is provided for the open end 16, said cap consisting of a planar portion 18 having an annular rim or flange 19 formed therearound and being hinged by hinge 20 to the upper side 21 of the one end 12 of the holder portion 10. It is preferable that a living hinge be used but of course other means of hinging may be provided.

This cap is adapted to hinge downwardly so that the flange 19 engages snuggly over the outer surface of the wall of the scoop defining the open end 16 and detent means are provided to detachably retain the cap in the closed position. FIG. 5 shows one method of retaining the cap in the closed position consisting of an enlargement 22 on the inner surface of the lower side 23 of the flange or rim 19 which snap engages within a dimple or small depression 24 formed in the outer surface 25 of the lower side 26 of the scoop 15.

It will be noted that the end of the scoop defining the opening 16 is inclined upwardly and rearwardly at an angle from the lower side 26 thereof at an angle of approximately 40° from the vertical and this facilitates the positioning of the coins or the like within the tube for ease of dispensing as with hereinafter be described.

The dispensing assembly or portion 13 at the other end 14 of the tubular holder portion 10 consists of a substantially planar base portion 27 which is an extension of the lower wall or base 28 of the holder portion 10 and this inclines downwardly and forwardly from the end 14 as clearly shown in FIG. 1.

The upper side 29 of the holder portion 10 inclines downwardly at a similar angle to the base 27 and is cut away as at 30 to define a pair of flanges 31 spaced above the sides of the base 27 with the inner edges 32 of the flanges facing one another in spaced apart relationship thus defining, with the sides of the base 27, a pair of channels 33 so that the base 27 and the channels 33 form a chute extending downwardly from the end 14 of the holder portion 10 and terminate at a discharge slot 34 at the lower front side of the dispenser portion 13, said discharge slot being transversely situated and in a transverse plane below the base or lower side 28 of the holder portion 10.

Figure 8:
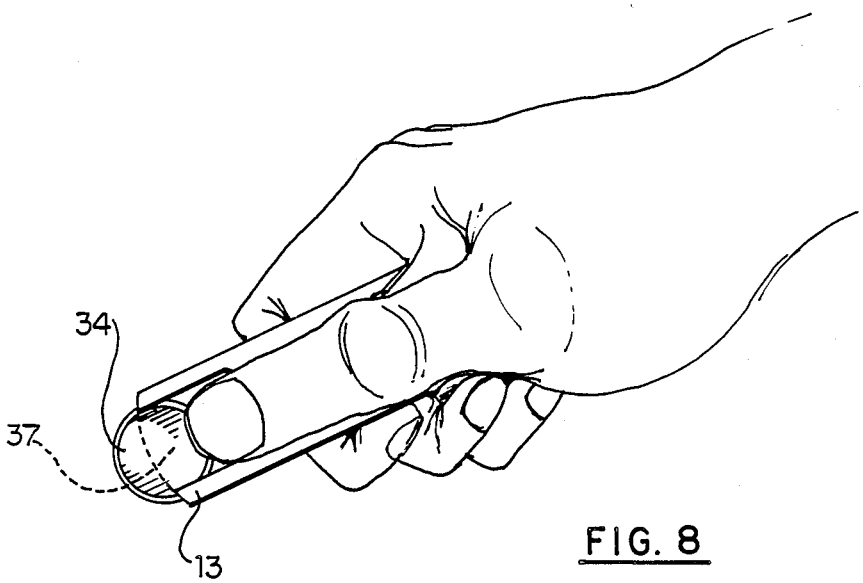
FIG. 8 is an isometric view showing the device in use.

The area between the flanges 31 on the upper side of the chute permits access by the user for the dispensing of coins tokens or the like as desired, it being understood from FIG. 8 that the device is grasped in the fingers of the hand with the underside of the thumb covering this open area so that it may be used to eject coins through the slot 34 as desired.

Means are provided to selectively retain individual coins within the dispensing section and between the flanges 33 until it is desired to eject same and FIGS. 6 and 7 show two such embodiments. In FIG. 7, a portion 35 extends downwardly from the surface 36 of the flange 31 thus restricting the downward movement of the coin, the edge of which is situated within the two channels 33. Forward movement by the operator of the thumb upon the surface of the coin 37 will force the coin past the detent 35 due to the resiliency of the material from which the device is manufactured thus enabling the coin to be ejected through the discharge slot 34.

In FIG. 7, the vertical wall portions 38 of the channels 33 are slotted to form a strip 39 upon each side of the channels 33 with the inner ends being free and the rear ends being attached to the vertical portions 38. These inner ends are curved inwardly slightly as shown at 40 and act as detents to the coin 37 as clearly shown in FIG. 6. Once again forward movement of the coin by the thumb of the operator forces the coin past the inner ends 40 which flex outwardly as the coin passes thereby and then move back to the position shown in FIG. 6 to temporarily restrain the next coin until it is desired to dispense same.

An elongated slot 41 is formed through the upper surface 42 of the tubular holder portion to allow the operator to view the edges of the coins retained within the holder portion and indicia 43 may be used on the outer surface of the holder portion 10 and adjacent the slot 41 to indicate the values of the number of coins remaining.

In operation, coins or the like are scooped into the open end 16 of the device which is then elevated until they slide towards the discharge end 14 whereupon the cap 18 may be snap engaged over the open end to prevent displacement of the coins through the scoop. The diameter of the tube is slightly less than the diameter of the coins to be dispensed therefrom and the tube is positioned in order to scoop the coins, reversed with respect to FIGS. 1 and 2 and with the cap held back clear of the leading edge of the scoop so that coins tend to enter the tube in the correct orientation for easy dispensing. As will hereinafter be described, it is preferable that the closure means be hinged to the base of the end of the dispensing means rather than the top as shown in FIGS. 1 to 5.

A forward and rearward shaking motion by the operator will sort the coins into the inclined relationship shown in phantom in FIG. 1 substantially aligned with the angle of inclination of the ends 12 and 13 due to the angle of inclination of the planar surface 18 of the cap when closed and the downwardly and forwardly inclining upper surface of the dispensing assembly 13 defined by the flanges 31.

A slight downward shaking movement by the hand of the operator will cause the front coin to slide downwardly into the chute restrained from further movement by the detents 40 or 35 or any other detent method utilized whereupon the thumb of the operator resting over the coin within the chute may urge same forwardly to discharge same through the transverse slot 34 directly into the slot of a machine or the like or into the other hand of the operator if desired. The angle of inclination of the coins, as long as the device is sloping downwardly slightly, will cause the next successive coin to slide into position within the chute and to be detachably retained until required.

The device will thus provide rapid and easy loading, ease of gathering the coins in the desired orientation within the tube and ease and cleanliness of rapid dispensing one by one as desired directly into a slot of a slot machine, also if desired.

At any time, a forward and rearward shaking action will realign coins in the desired position ready for further dispensing as required. It will be noted that the edges 32A of the flanges 31 gradually incline towards the longitudinal centre of the tube when viewed in plan so that the areas 32B act as front walls to restrain coins against downward movement and into the chute until the coin within the chute is dispensed.

It will be noted from FIG. 1 that the second coin ready to be dispensed, underlies the first coin with the first coin restraining the second coin until the first coin is dispensed whereupon the second coin moves into the position vacated by the first coin and holds back the next succeeding coin.

Figure 9:
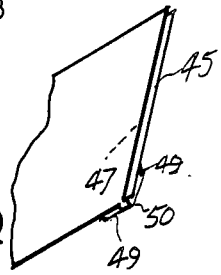
FIG. 9 is a fragmentary view similar to FIG. 5 but showing the preferred embodiment of the cap or closure.
Figure 10:
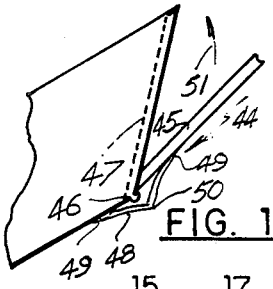
FIG. 10 is a view similar to FIG. 9 but with the cap or closure in the closed position.
Figure 2:
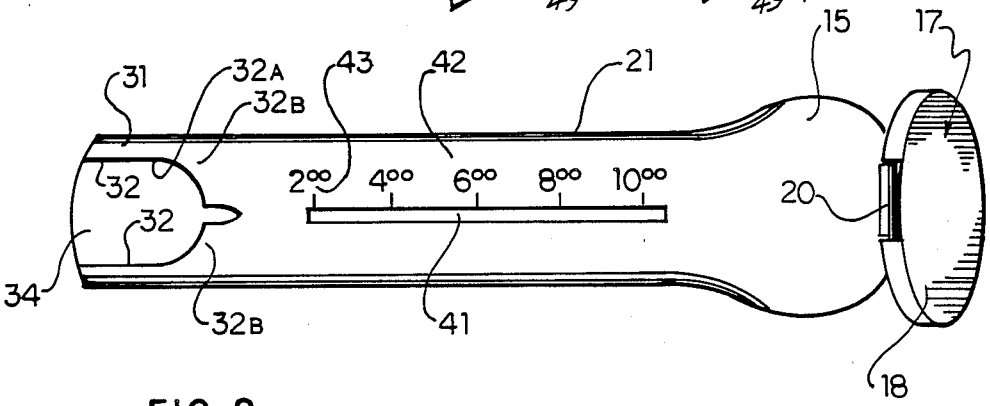
FIG. 2 is a top plan view of FIG. 1 but with the cap in the opened position.

FIGS. 9 and 10 showed the preferred embodiment of the closure means identified by reference character 44. This consists of a disk 45 secured by a living hinge 46 to the base or lower side 26 of the scoop end and when engaged upwardly to cover the scoop end, it nests within the end and is retained against an annular bead 47 spaced inwardly from the scoop end on the inner wall thereof and may either be retained by snap engagement with a means somewhat similar to that shown and described in FIG. 5 but formed on the inner side of the scoop end. However, preferably, a spring member 48 is formed integrally with the disk 45 and the portion 26 of the scoop end, connecting to both by means of living hinges 49 and taking the position when in the open position of FIG. 9, as illustrated with the angulation 50 being pre-set into the hinge strip 48. As the disk is urged towards the closed position in the direction of arrow 51, the spring passes over centre and then snaps the cover plate or disk into position and maintains it there until it is once again urged towards the open position. When this occurs, the strip 48 once again passes over its centre and snaps and retains it to the open position illustrated. Such a hinge is conventional for snap tops but other methods of course may be utilized.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A device for the loading, storing and selective dispensing of coins, tokens and the like comprising an elongated tubular holder portion having a lower side, loading means at one end thereof and selective dispensing means at the other end thereof, said selective dispensing means including a transversely situated dispensing slot adjacent the distal end of said other end and forwardly thereof and situated in a plane below said lower side of said tubular holder portion and including inclined chute means operatively connecting said slot with said other end of said tubular portion, said chute means including a substantially planar base portion inclining upwardly towards said lower side of said tubular holder portion and blending into said lower side with a smooth curve, said base portion extending at an obtuse angle from said lower side, the cross sectional configuration of the dispensing means increasing from said slot to the full diameter of said tubular holder portion whereby the orientation of a coin, token or the like changes from a position spanning said tubular holder portion in which the vertical plane of the coin, token or the like is at a rearwardly inclined angle to the horizontal longitudinal axis of the tubular holder portion, to a planar position upon said base portion of said dispenser means and means to detachably retain said coin, token or the like upon said base portion until dispensed through said slot.

2. The device according to claim 1 in which said loading means includes a scoop formed at said one end of said tubular portion, the plane of the open end of said scoop inclining upwardly and rearwardly from the lower side of said tubular holder portion and lying substantially parallel to the plane of said base portion of said dispensing means.

3. The device according to claim 2 in which said coin, token or the like may be orientated to lie in a similar plane to the plane of the open end of said scoop and the plane of the lower side of said tubular holder portion.

4. The device according to claim 2 which includes selectively openable closure means for said one end, said closure means including a cap hinged by said one end of the lower side of said tube holder portion and being selectively engageable with said one end when in the closed position.

5. The device according to claim 1 in which said dispensing means includes flanges spaced above the longitudinal edge of said base portion and facing inwardly towards one another thereby defining a pair of opposed channels, with the inner edges of said flanges defining an open, thumb engaging aperture therebetween on the upper side of said dispensing means, said base portion and said flanges defining a guide chute for the coins, tokens and the like ejectable therefrom.

6. The device according to claim 5 in which said loading means includes a scoop formed at said one end of said tubular portion, the plane of the open end of said scoop inclining upwardly and rearwardly from the lower side of said tubular holder portion and lying substantially parallel to the plane of said base portion of said dispensing means.

7. The device according to claim 6 in which said coin, token or the like may be orientated to lie in a similar plane to the plane of the open end of said scoop portion and the plane of the lower side of said tubular holder portion.

8. The device according to claim 6 which includes selectively openable closure means for said one end, said closure means including a cap hinged by said one end of the lower side of said tube holder portion and being selectively engageable with said one end when in the closed position.

9. The device according to claim 5 in which said means to detachably retain said coins, tokens or the like upon said base portion includes resilient detent means within at least one of said channel retaining the associated coin, token or the like.

10. The device according to claim 9 in which said means to detachably retain said coins, tokens or the like upon said base portion includes a resilient strip formed in the wall of at least one of said channels, one end being secured to said wall and the other end being free and facing said dispensing slot and inclining inwardly towards the longitudinal axis of said base portion of said dispensing means, to detachably retain said coin, token or the like against inadvertent movement towards said slot.

11. The device according to claim 1 which includes a longitudinally extending slot formed through the upper side of said tubular holder portion for viewing the edges of the coins, tokens and the like therewithin.

12. The device according to claim 11 which includes indicia upon the outer surface of said tubular holder portion adjacent said slot for indicating the value and/or quantity of coins, tokens and the like remaining within said device.

13. The device according to claim 1 in which the diameter of said tubular holder portion is less than the diameter of said coins, tokens and the like whereby said coins, tokens and the like may lie in a plain substantially parallel to the plane of the open end of said scoop portion and the plane of the lower side of said tubular holder portion.

14. The device according to claim 2 which includes a longitudinally extending slot formed through the upper side of said tubular holder portion and indicia upon the outer surface of said tubular holder portion adjacent said slot for indicating the value and/or quantity of coins, tokens and the like remaining within said device.

15. The device according to claim 3 which includes a longitudinally extending slot formed through the upper side of said tubular holder portion and indicia upon the outer surface of said tubular holder portion adjacent said slot for indicating the value and/or quantity of coins, tokens and the like remaining within said device.

16. The device according to claim 4 which includes a longitudinally extending slot formed through the upper side of said tubular holder portion and indicia upon the outer surface of said tubular holder portion adjacent said slot for indicating the value and/or quantity of coins, tokens and the like remaining within said device.

17. The device according to claim 6 which includes a longitudinally extending slot formed through the upper side of said tubular holder portion and indicia upon the outer surface of said tubular holder portion adjacent said slot for indicating the value and/or quantity of coins, tokens and the like remaining within said device.

18. The device according to claim 4 which includes an over centre spring means operatively extending between said closure means and the lower side of said tubular portion selectively urging said closure means towards the open and closed positions.

19. The device according to claim 8 which includes an over centre spring means operatively extending between said closure means and the lower side of said tubular portion selectively urging said closure means towards the open and closed positions.

* * * * *